US009162354B1

(12) United States Patent
Wang

(10) Patent No.: US 9,162,354 B1
(45) Date of Patent: Oct. 20, 2015

(54) HANDLE COVER STRUCTURE

(71) Applicant: GREEN GUARD INDUSTRY LTD., Taichung (TW)

(72) Inventor: Kuang-Ta Wang, Taichung (TW)

(73) Assignee: Green Guard Industry Ltd., Taichung (TW)

( * ) Notice: Subject to any disclaimer, the term of this patent is extended or adjusted under 35 U.S.C. 154(b) by 45 days.

(21) Appl. No.: 14/225,621

(22) Filed: Mar. 26, 2014

(51) Int. Cl.
*B25G 1/10* (2006.01)

(52) U.S. Cl.
CPC ..... *B25G 1/102* (2013.01)

(58) Field of Classification Search
CPC ..... Y10T 16/12; Y10T 16/18; Y10T 16/19; Y10T 16/44; Y10T 16/466; Y10T 16/469; Y10T 16/476; Y10T 16/498; Y10T 16/20828; A47B 95/02; A63B 59/0014; A63B 53/14; A63B 49/08; A63C 11/222; A45B 9/02; A01K 87/08; B25G 23/16; B25G 1/00; B25G 1/105; B25G 1/102; B25G 1/10; B25G 1/01; B25G 1/005; B25G 3/00; B25G 3/38; B25G 3/36; B25G 3/34; B26B 1/10; B05C 17/0205; B62K 21/26; B29L 2031/463; G26B 21/52
See application file for complete search history.

(56) References Cited

U.S. PATENT DOCUMENTS

| | | | | | |
|---|---|---|---|---|---|
| 2,037,943 | A | * | 4/1936 | Stiehl et al. | 30/340 |
| 2,605,945 | A | * | 8/1952 | Dechar | 294/146 |
| 2,987,149 | A | * | 6/1961 | Finkelstein | 16/408 |
| 3,266,081 | A | * | 8/1966 | Heim | 16/110.1 |
| 3,833,219 | A | * | 9/1974 | Dean | 473/523 |
| 4,364,150 | A | * | 12/1982 | Remington | 16/409 |
| 4,537,399 | A | * | 8/1985 | Adam | 473/552 |
| 5,083,825 | A | * | 1/1992 | Bystrom et al. | 294/171 |
| 5,839,163 | A | * | 11/1998 | Hellmann | 16/436 |
| 6,138,734 | A | * | 10/2000 | Hamisch, Jr. | 156/384 |
| 6,167,592 | B1 | * | 1/2001 | Tsai | 16/411 |
| 6,516,496 | B2 | * | 2/2003 | Ekron | 16/422 |
| 7,980,415 | B2 | * | 7/2011 | Crawley | 220/755 |
| 2002/0073554 | A1 | * | 6/2002 | Chen | 30/169 |
| 2003/0084545 | A1 | * | 5/2003 | Cheng | 16/430 |
| 2004/0231100 | A1 | * | 11/2004 | Schultz et al. | 16/110.1 |
| 2007/0018471 | A1 | * | 1/2007 | Pandura | 296/1.02 |
| 2007/0074401 | A1 | * | 4/2007 | Myers et al. | 30/142 |
| 2008/0014412 | A1 | * | 1/2008 | Hortnagl et al. | 428/172 |
| 2009/0183591 | A1 | * | 7/2009 | Jesse | 74/551.9 |
| 2010/0126301 | A1 | * | 5/2010 | Yu | 74/551.9 |
| 2012/0222525 | A1 | * | 9/2012 | Qiu | 81/489 |
| 2013/0048039 | A1 | * | 2/2013 | Heim | 135/65 |
| 2013/0098213 | A1 | * | 4/2013 | Lindblom, Jr. | 81/177.85 |
| 2014/0057734 | A1 | * | 2/2014 | Lu | 473/298 |
| 2014/0260773 | A1 | * | 9/2014 | Arnold | 74/551.9 |

FOREIGN PATENT DOCUMENTS

| | | | | |
|---|---|---|---|---|
| FR | 2665097 | A1 | * | 1/1992 |
| JP | 2001121451 | A | * | 5/2001 |

* cited by examiner

*Primary Examiner* — Chuck Mah
(74) *Attorney, Agent, or Firm* — Rosenberg, Klein & Lee

(57) ABSTRACT

A handle cover structure includes two casings and a connecting element, and the two casings are engaged with each other to form a sleeve having a hollow inner side and at least one open end for sheathing on a handle. Each casing has an external surface facing an outer side of the sleeve, an internal surface facing an inner side of the sleeve, a first recess formed on the external surface of each casing, and a through hole penetrating into the internal surface of the casing; and the connecting element is flexible and disposed on the external surfaces of the two casings, and both ends of the connecting element are passed into the through holes from the first recesses of the casings, extended into the inner side of the sleeve, and fixed onto the internal surfaces of the casings respectively.

9 Claims, 7 Drawing Sheets

HANDLE COVER STRUCTURE

FIELD OF THE INVENTION

The present invention relates to a handle cover structure, in particular to a handle cover securely combined with a decorative element.

BACKGROUND OF THE INVENTION

Most common tools used in our daily life come with a handle cover sheathed on a handle of the tools to achieve the anti-slip effect and improve the comfort of holding the handle and usually has a decorative element installed on the exterior of the handle cover to improve the aesthetic look. However the decorative element is attached onto the handle cover by adhesive, the decorative element may be separated from the handle cover easily due to uneven forces applied onto the handle of the tool or moisture entering into the handle to deform the handle and separate the decorative element from the handle. As a result, both of the use and appearance of the tool are affected adversely.

SUMMARY OF THE INVENTION

In view of the drawbacks of the prior art, it is a primary objective of the present invention to provide a handle cover structure having a connecting element for connecting two casings that can be engaged with each other to form a handle cover, and after the two casings are engaged, the connecting element is tightly and flatly fixed to the exterior of the two casings to provide a decorative effect and achieve the effect of securing the casings to prevent them from falling out.

To achieve the aforementioned objective, the present invention provides a handle cover structure comprising two casings and a connecting element characterized in that the two casings are engaged with each other to form a sleeve having a hollow inner side and at least one open end for sheathing on a handle, and each casing has an external surface facing an outer side of the sleeve, an internal surface facing an inner side of the sleeve, a first recess formed on the external surface of each casing, and a through hole penetrating into the internal surface of the casing; and the connecting element is flexible and disposed on the external surfaces of the two casings, and both ends of the connecting element are passed into the through holes from the first recesses of the casings, extended into the inner side of the sleeve, and fixed onto the internal surfaces of the casings respectively.

Wherein, the first recesses of the two casings are coupled to each other after the sleeve is assembled.

In addition, each casing has a second recess formed on the internal surface of the casing, and after both ends of the connecting element are fixed to the second recesses of the casings after being extended into the inner side of the sleeve.

Further, the positioning portion is erected and has a height slightly smaller than or equal to the depth of the second recess, so that when the sleeve is sheathed on the handle, the internal surface and each positioning portion of each casing are approximately attached to the handle.

DESCRIPTION OF THE PREFERRED EMBODIMENTS

Figure 1:
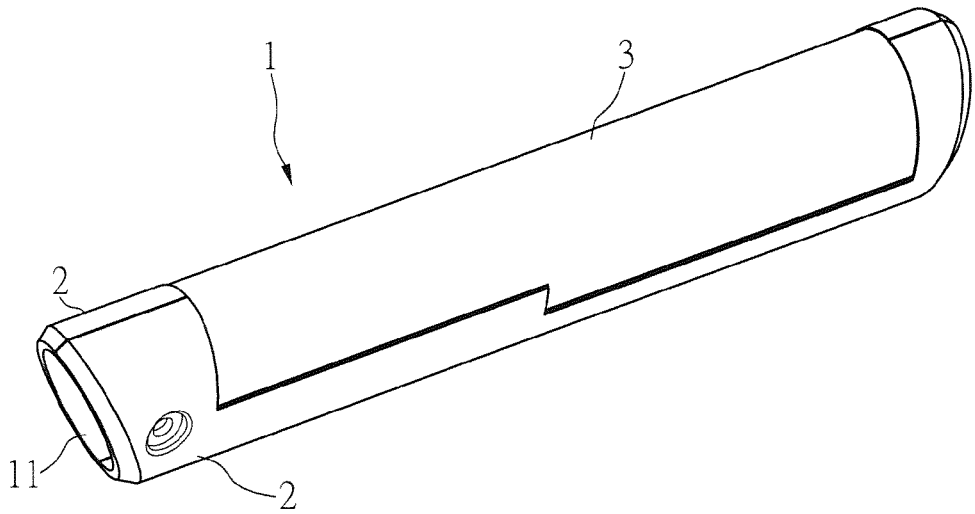
FIG. 1 is a perspective view of a handle cover structure of the present invention.
Figure 2:
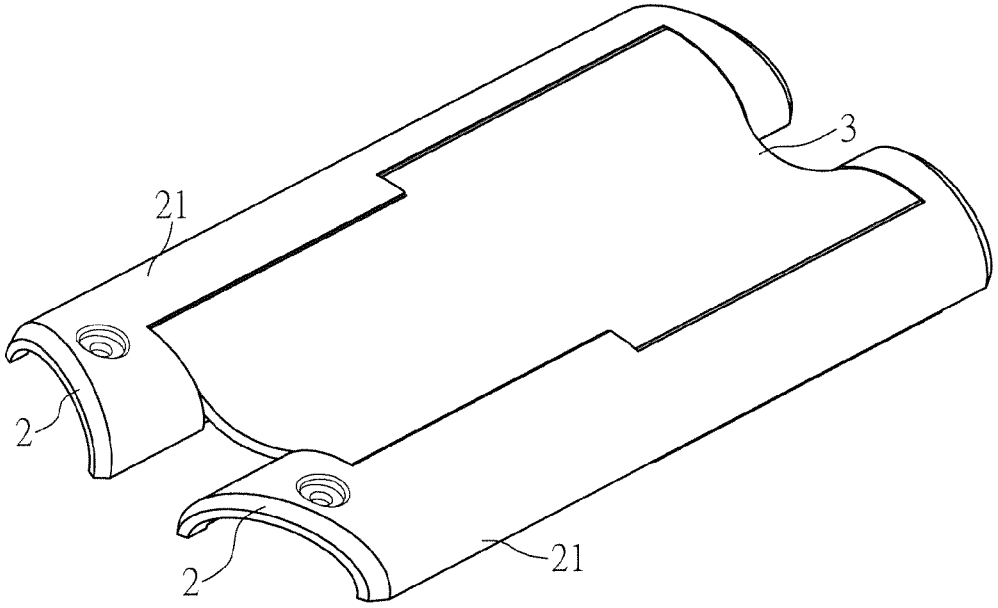
FIGS. 2 and 3 are perspective views of a semi-assembled status of a handle cover structure of the present invention.
Figure 3:
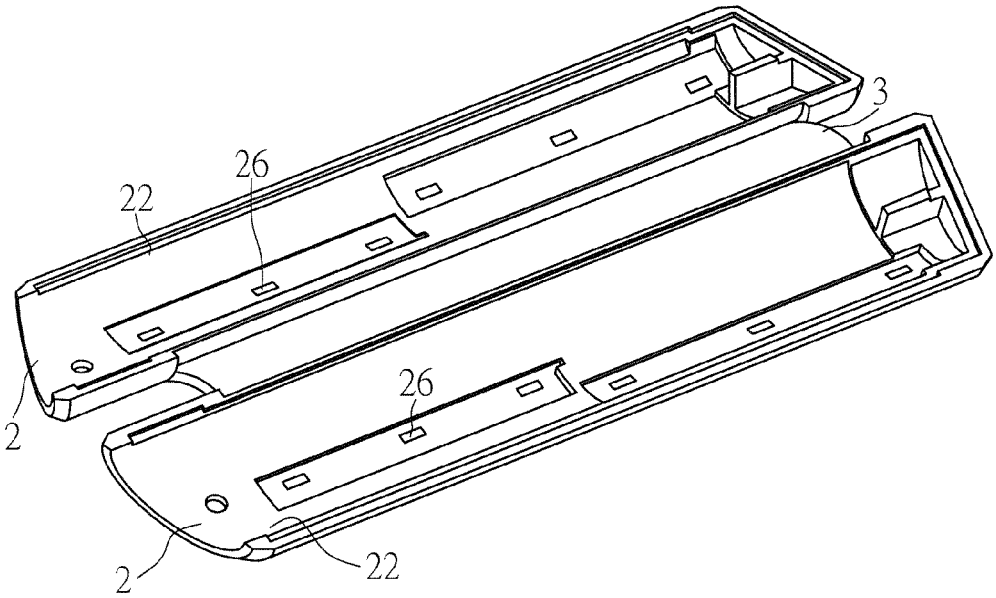
Figure 4:
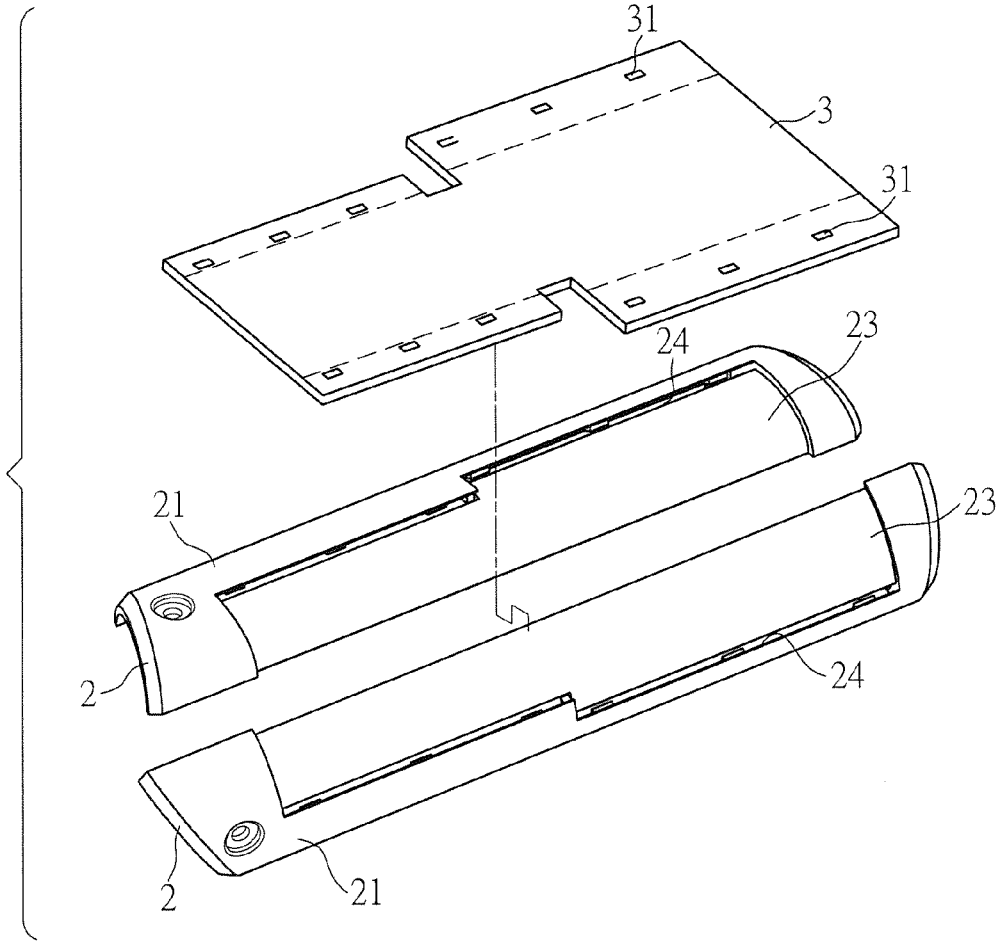
FIGS. 4 and 5 are exploded views of a handle cover structure of the present invention.
Figure 5:
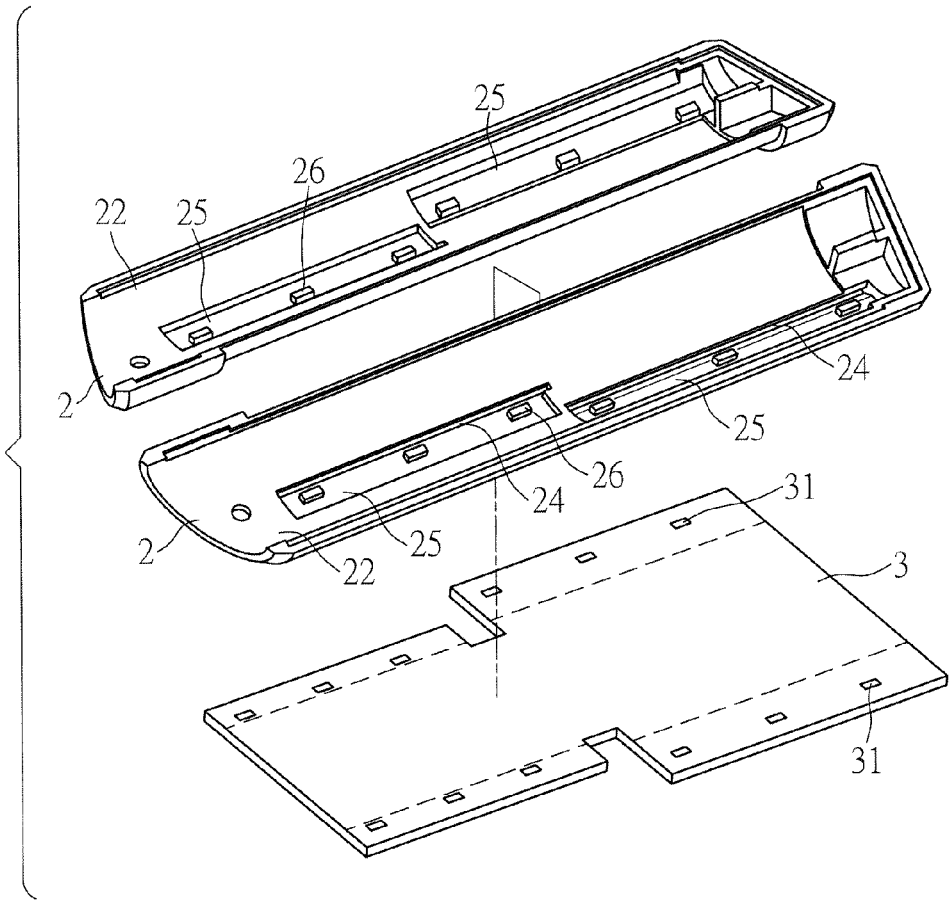

The present invention will become clearer in light of the following detailed description of an illustrative embodiment of this invention described in connection with the drawings. It is intended that the embodiments and drawings disclosed herein are to be considered illustrative rather than restrictive.

With reference to FIGS. 1 to 5 for a handle cover structure of the present invention, the handle cover structure is a sleeve 1 formed by combining two casings 2 and a connecting element 3 and sheathed on a handle. In this preferred embodiment, the two casings 2 are in an arc shape and symmetrical to each other, and the two casings 2 are engaged to form a sleeve 1 with an hollow inner side and having an opening 11 formed at an end of the sleeve 1. Each casing 2 has an external surface 21 facing the outer side of the sleeve 1 and an internal surface 22 facing the inner side of the sleeve 1, and the external surface 21 of each casing 2 has a first recess 23 and a through hole 24 penetrating through the internal surface 22. In this preferred embodiment, the first recess 23 is a shallow groove disposed on a corresponding connecting side of each casing 2, so that after the two casings 2 are engaged to form the sleeve 1, the first recesses 23 of the two casings 2 are connected.

The connecting element 3 is substantially a decorative element which is made of natural leather in this preferred embodiment, and the connecting element 3 is installed to the exterior of the sleeve 1 to improve the aesthetic visual effect and provide a better hand grip, the present invention skillfully combine the decorative element with the sleeve 1 and secure the connecting element 3 to the sleeve 1. More specifically, both ends of the connecting element 3 are connected to the two casings 2 to integrate the three into one, wherein the connecting element 3 is installed onto the first recesses 23 of two casings 2, and both ends of the connecting element 3 are passed through the through holes 24, extended into the internal surface 22 of each casing 2, and fixed onto the internal surface 22. In this preferred embodiment, each casing 2 has a second recess 25 formed on an internal surface 22 of the casing 2 and the second recess 25 is also a shallow groove having a plurality of erected positioning portions 26 therein, wherein each positioning portion 26 has a height slight smaller than or equal to the depth of the second recess 25, so that each positioning portion 26 is aligned evenly with the internal surface 22 of the casing 2. Both ends of the connecting element 3 have a plurality of positioning holes 31, and the connecting element 3 is fixed to the positioning portion 26 through the positioning holes 31. Further, the positioning portion 26 is made of a plastic material, and the top of each positioning portion 26 is hot-melted to form a flat protruding flange for pressing the connecting element 3 to enhance the fixation.

The connecting element has a thickness equal to the depth of the first recess 23, so that the external surface of the connecting element 3 is aligned evenly with the external surface 21 of the casing 2. After the two casings 2 are engaged to form the sleeve 1, the connecting element 3 is fixed to the two casings 2 and situated at a tensed status due to the pulling force. Although the connecting element 3 is not connected with the external surface 21 of the two casings 2 in any form, the connecting element 3 can be maintained on the sleeve 1 and will not fall out easily.

Figure 6:
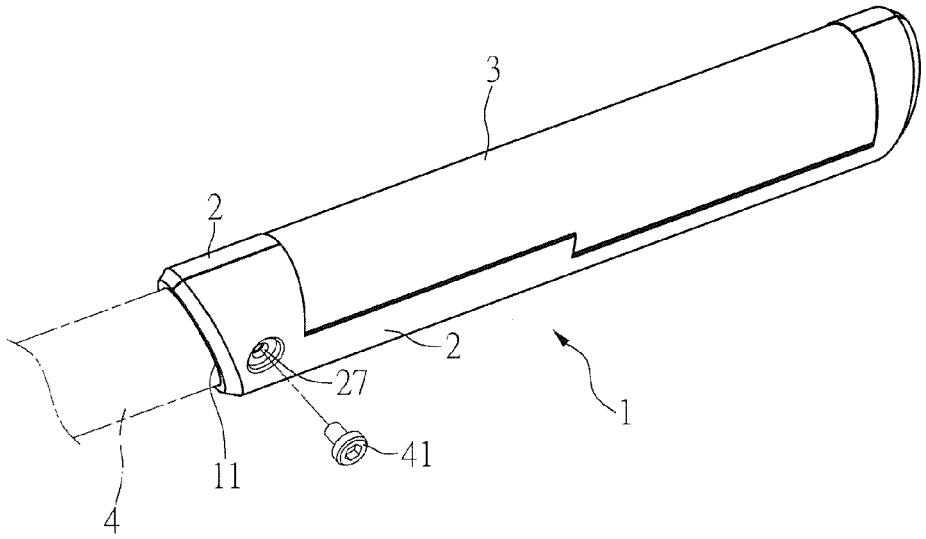
FIG. 6 is a perspective view of a handle cover structure of the present invention installed onto a handle.
Figure 7:
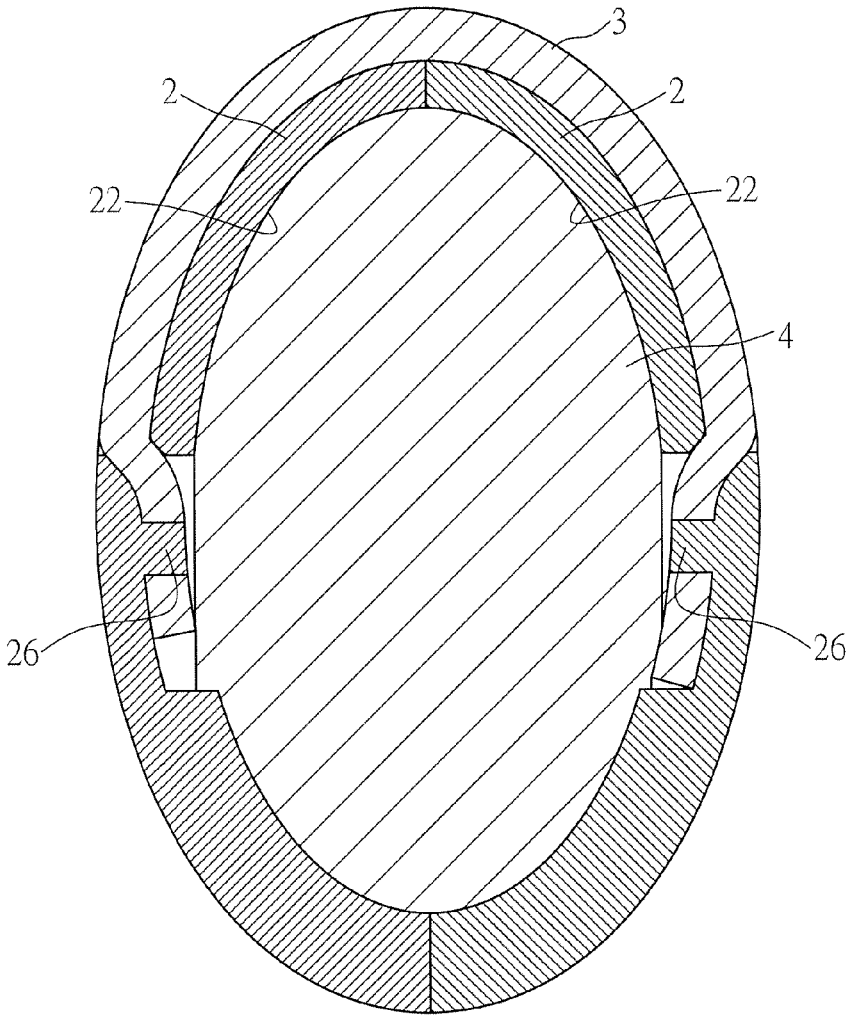
FIG. 7 is a sectional view of a handle cover structure of the present invention.

In FIG. 6, the handle cover of the present invention is sheathed on a handle 4. More specifically, the handle 4 is assembled from an opening 11 at an end of the sleeve 1 which is comprised of the two casings 2. In this preferred embodiment, each casing 2 has a fixing hole 27 for passing a screw 41 to secure each casing 2 onto the handle 4, so as to fix the sleeve 1 to the handle 4 more securely. In this preferred embodiment, the sleeve 1 has an internal diameter equal to the external diameter of the handle 4, such that when the handle 4 is assembled to the sleeve 1 as shown in FIG. 7, the handle 4 is tightly connected with the internal surface 22 of each casing 2. Due to the height of each positioning portion 26, the gap between the top of each positioning portion 26 and the handle 4 is very small, or there is no gap at all, so that the connecting element 3 cannot fall out from the positioning portion 26 to assure the secured connection of the connecting element 3 with each casing 2.

In summation of the description above, the present invention improves over the prior art, and is thus duly filed for patent application. While the invention has been described by means of specific embodiments, numerous modifications and variations could be made thereto by those skilled in the art without departing from the scope and spirit of the invention set forth in the claims.

What is claimed is:

1. A handle cover structure, comprising two casings and a connecting element, characterized in that the two casings are engaged with each other to form a sleeve having a hollow inner side and at least one open end for sheathing on a handle, and each casing has an external surface facing an outer side of the sleeve, an internal surface facing an inner side of the sleeve, a first recess formed on the external surface of each casing, and a through hole penetrating into the internal surface of the casing; and the connecting element is flexible and disposed on the external surfaces of the two casings, and both ends of the connecting element are passed into the through holes from the first recesses of the casings, extended into the inner side of the sleeve, and fixed onto the internal surfaces of the casings respectively.

2. The handle cover structure of claim 1, wherein the first recesses of the two casings are coupled to each other after the sleeve is formed.

3. The handle cover structure of claim 1, wherein each casing has a second recess formed on the internal surface of the casing, and both ends of the connecting element are fixed to the second recesses of the casings after being extended into the inner side of the sleeve.

4. The handle cover structure of claim 3, wherein the second recess of each casing has a plurality of positioning portions, and both ends of the connecting element are fixed to the positioning portions after extending into the inner side of the sleeve.

5. The handle cover structure of claim 4, wherein the positioning portion is erected and has a height slightly smaller than or equal to the depth of the second recess, so that when the sleeve is sheathed on the handle, the internal surface and each positioning portion of each casing are approximately attached to the handle.

6. The handle cover structure of claim 4, wherein the connecting element has a plurality of positioning holes formed at both ends of the connecting element, and after the connecting element is extended into the second recess of each casing, the connecting element is fixed the positioning portion through the positioning hole.

7. The handle cover structure of claim 1, wherein each casing has a plurality of positioning portions disposed on an internal surface of he casing, and both ends of the connecting element have a plurality of positioning holes, and after the connecting element is extended into the inner side of the sleeve, the connecting element is fixed to the positioning portion through the positioning hole.

8. The handle cover structure of claim 1, wherein the connecting element is made of natural leather.

9. The handle cover structure of claim 1, further comprising a screw passing through each casing to lock the casing to the handle.

* * * * *